United States Patent [19]

Gentry

[11] Patent Number: 4,889,483

[45] Date of Patent: Dec. 26, 1989

[54] TEMPERATURE CONTROLLED PROBE ASSEMBLY

[75] Inventor: Charles B. Gentry, Belmont, Mich.

[73] Assignee: Granco-Clark, Inc., Belding, Mich.

[21] Appl. No.: 647,931

[22] Filed: Sep. 6, 1984

[51] Int. Cl.[4] ..... F27D 19/00; F23N 1/00

[52] U.S. Cl. ..... 432/49; 236/15 BB; 374/179; 374/208

[58] Field of Search ..... 236/15 BB, 15 BR, 15 BC; 374/179, 158, 208, 209; 361/384; 432/49

[56] References Cited

U.S. PATENT DOCUMENTS

| | | | |
|---|---|---|---|
| 3,409,217 | 11/1968 | Gentry | 236/15 |
| 3,921,452 | 11/1975 | Sartorius | 374/179 |
| 4,257,552 | 3/1981 | Farkas et al. | 361/384 X |
| 4,309,171 | 1/1982 | Gentry | 432/163 |

*Primary Examiner*—William E. Wayner

*Attorney, Agent, or Firm*—Varnum, Riddering, Schmidt & Howlett

[57] ABSTRACT

A temperature controlled probe assembly (58) for measuring log temperatures in a furnace (10) for heating metal logs (20) includes a carriage (88) selectively movable by a pneumatically controlled air cylinder (64). The carriage (88) includes a barrel (92) having an air chamber (102), a pair of thermocouple probe rods (40, 42) extending through the barrel (92), and cooling air channels (126) opening into the air chamber (102) for supplying air to cool the probes (40, 42). Another thermocouple (94) measures the temperature of the environment surrounding the thermocouple probe rods (40, 42) and a cooling air regulator (160) is selectively actuated when the temperature of the probe environment is greater than a predetermined temperature. The regulator (160) varies the amount of cooling air supplied to the probe rods (40, 42) in accordance with the amount of combustion air being used by the furnace (10).

17 Claims, 5 Drawing Sheets

TEMPERATURE CONTROLLED PROBE ASSEMBLY

DESCRIPTION

1. Technical Field

The invention relates to measuring temperatures of metal articles in furnaces adapted to heat the articles to an elevated set point temperature and, more particularly, to systems for regulating the temperatures of probe devices used in measuring such temperatures.

2. Background Art

Furnaces for heating metal articles to relatively high temperatures for subsequent metal processing operations, such as extrusions and the like, have commonly been used for many years. These furnaces typically include an elongated heating chamber through which the articles are moved. Heating devices, such as air/fuel combustion burners, are disposed along the length of the chamber to apply energy to the articles so as to heat the articles to a predetermined temperature or "set point."

The metal articles can be in the form of billets, which typically comprise relatively large diameter cylinders with precut lengths which are intermittently pushed through the furnace heating chamber. Recently, metal "logs" having greater lengths have also been employed. The logs are moved into the furnace chamber, heated to the appropriate set point temperature, moved out of the chamber where a predetermined log section length is cut away, and then returned into the furnace chamber.

To achieve and maintain the requisite set point temperature for the billets or logs, various types of temperature control systems can be employed. These control systems typically include probes to measure the article temperatures, and a control system for regulating the energy applied to the articles by the combustion heating devices. For example, the Gentry U.S. Pat. No. 3,409,217, issued on Nov. 5, 1968, discloses pairs of thermocouple probe rods moved into contact with billets when the billets are in a stationary position within an elongated heating chamber. The probe rods and the billets form closed conductive paths between the rods so that electric current flows therewithin. The magnitudes of the currents flowing through the rod pairs are dependent upon the temperatures of the billets. The currents through the probe rods are utilized by various electrical control apparatus to compare the measured temperatures with the desired set point temperature and apply control signals to a combustion heating system to regulate the energy applied to the billets based on the comparison results.

One problem associated with the measurement of article temperatures in severe environments, such as the high temperature environment of a furnace heating chamber, is that the accuracy of the temperature measuring devices is sensitive to various environmental factors. For example, with the use cf probe rods as described in the Gentry patent, the magnitude of the electric current will be somewhat dependent upon the temperature differential between the probe rods and the billet portion between the contacting ends of the probe rods.

It has also been found that the temperature of the rods themselves tends to increase above the temperature of the billets. With the probe rods having a higher temperature than the billets, the billets actually act as a "heat sink" for the probe rods as the rods are brought into contact with the billets, thereby causing inaccurate billet temperature measurements.

SUMMARY OF THE INVENTION

In accordance with the invention, a furnace having a heating chamber for heating articles to an elevated set point temperature has thermocouple probe rods for measuring the temperature of the articles, means for measuring the temperature of the thermocouple probe rods themselves and means for supplying cooling air to the thermocouple probe rods in accordance with the temperature differential between the rods and the set point and the rate of air flow to a furnace combustion assembly. The furnace includes combustion means for generating and applying energy within the heating chamber to heat the articles, and means to regulate the energy applied to the articles by the combustion means in accordance with the temperature sensed by the thermocouple probe rods.

The thermocouple probe rods are mounted for selective movement into contact with the articles. Environmental temperature measuring means measure the temperature of the environment surrounding the thermocouple probe rods or the temperature of the actual thermocouple probe rods. The environmental temperature measuring means further generates an environmental temperature signal representative of the measured temperature. Cooling air supply means, for example, from a combustion air supply means, are responsive to the environmental temperature signal to selectively supply cooling air to the thermocouple probe rods when the environmental temperature is greater than a predetermined temperature. In addition, the cooling air supply means includes regulator means for adjusting the flow of supplied cooling air to the thermocouple probe rods in accordance with the rate cf air flow through the combustion air supply means.

The regulator means includes means for detecting the flow of combustion air downstream of a flow control valve as a measure of the rate of combustion air supplied to the combustion means. The regulator means also includes means for selectively supplying the combustion air as cooling air to the thermocouple probe rods, with the amount of supplied combustion air being regulated in accordance with the amount of detected combustion air downstream of the control valve.

The cooling air supply means includes comparison means responsive to the environmental temperature signal and to a signal representative of the predetermined temperature to generate an activation signal when the environmental temperature is greater than the predetermined temperature. Switch means are responsive to the activation signal to activate the regulator means to supply combustion air to the thermocouple probe rods.

The environmental temperature measuring means can comprise at least one thermocouple located adjacent the thermocouple probe rods. The thermocouple probe rods are mounted so as to be selectively movable into contact with the articles. Air channels extend through mounting means, at least partially surround the probe rods and communicate with the cooling air supply means to allow cooling air to be applied around and along the thermocouple probe rods.

A probe carriage comprises an elongated barrel having an air chamber and an insulative section adjacent the air chamber. The thermocouple probe rods extend longitudinally through the barrel, and air channels extend through the insulative section and receive the thermocouple probe rods. Collar means are provided to maintain communicative openings between the air channels and the air chamber.

The cooling air supply means include means communicating with the air chamber to supply cooling air to the thermocouple probe rods. The environmental temperature measuring means includes a thermocouple extending through the barrel adjacent the thermocouple probe rods, and the cooling air supply means include regulator means for adjusting the flow of supplied cooling air to the air chamber in accordance with the rate of air flow through the combustion air supply means. In addition, means are provided for moving the probe carriage between a retracted position and an extended position, with the thermocouple probe rods contacting the articles when the carriage is in the extended position.

A method in accordance with the invention for heating articles to an elevated set point temperature within a heating chamber includes the application of thermal energy within the chamber to heat the articles. The temperature of the articles is measured contacting the articles with a set of thermocouple probe rods, and the amount of applied energy is adjusted in accordance with the measured article temperature. The method also includes the steps of measuring the temperature of the environment surrounding the thermocouple probe rods or the temperature of the actual thermocouple probe rods and supplying cooling air to the thermocouple probe rods when the environmental temperature is greater than a predetermined temperature.

A further method in accordance with the invention includes supplying air to a combustion device to generate thermal energy, and applying the thermal energy within the chamber to heat the articles. The temperature of the articles is measured by contacting the articles with a set of thermocouple probe rods, supplying cooling air to the thermocouple probe rods and regulating the amount of supplied cooling air in accordance with the combustion rate of the combustion device. In addition, air is supplied to the combustion device through an air supply pipe, and the amount of supplied air is adjusted by means of a flow control valve in the pipe. The cooling air is supplied to the thermocouple probe rods from the air flowing through the supply pipe upstream from the flow control valve, and the amount of air flowing through the supply pipe between the control valve and the combustion device is detected, with the volume of cooling air supplied to the probe rods adjusted in accordance therewith.

BRIEF DESCRIPTION OF THE DRAWINGS

A preferred embodiment of the invention will now be described with reference to the drawings in which.

DISCLOSURE OF THE INVENTION

Figure 1:
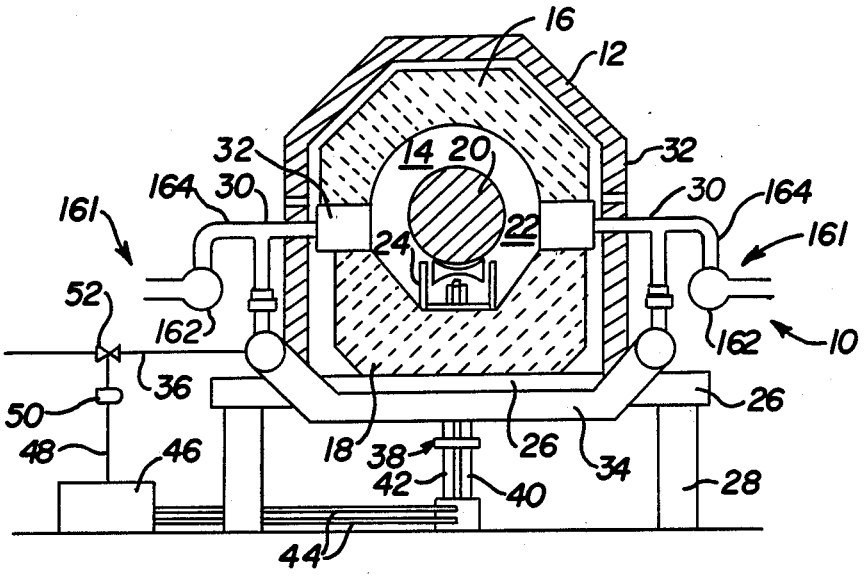
FIG. 1 is sectional end view of a furnace system in which a temperature controlled probe assembly in accordance with the invention can be employed.

The principles of the invention are disclosed, by way of example, within a probe assembly and heating system which can be adapted for use in billet or log heating furnaces such as the log heating furnace 10 as depicted in structural and block diagram form in FIG. 1. The log heating furnace 10 is adapted to heat to relatively high temperatures metal billets or logs 20 for purposes of subsequent extrusion or similar types of metal processing operations. The subsequent extrusion process can be utilized to form various shapes and sizes of metal products, such as those constructed of aluminum.

Referring to FIG. 1, the log heating furnace 10 includes a housing 12 having an interior heating chamber 14. The heating chamber 14 is formed between refractory material sections 16 and 18. Metal billets or logs 20 moving longitudinally through the heating chamber 14 are supported on rollers 22 mounted on a U-shaped channel 24. The basic structure of the log heating furnace 10 is supported by means of a lower support frame 26 mounted on upstanding support legs 28.

To heat the billets or logs 20 as they pass through the heating chamber 14, various types of combustion devices and methods can be employed. For example, the billets or logs 20 can be heated by a heating assembly 161 comprising a commercially known direct flame impingement method whereby a mixture of fuel and air is sprayed through mixture nozzles 30 and ignited in apertures 32 which open into the heating chamber 14.

The fuel for the combustion flame can be any conventional type of fuel such as a liquid or gas mixture, and is supplied to the mixture nozzles 30 by means of a common fuel header pipe 34 from fuel source pipe 36. The typical configuration of a log or billet heating furnace such as furnace 10 includes a series of zones or regions through which the logs or billets 20 are moved. Each zone or region can have its own heating assembly 161 associated therewith.

A combustion air header 162 includes conventional means for obtaining external air for purposes of producing a combustible mixture of air and fuel. The air obtained through the combustion air header 162 can be applied through a combustion air supply pipe 164 which is interconnected to the mixture nozzle 30. Assemblies to provide combustible mixtures of air and fuel for log heating furnaces in a manner so that the combustion rate or heat energy supplied to the logs 20 can be manually or automatically adjusted by adjustment of air or fuel flow are well-known in the art of log or billet heating furnace design.

To measure the temperature of the logs 20 as they pass through the heating chamber 14, a temperature sensing assembly 38 can be employed. The temperature sensing assembly 38 is positioned below the furnace 10 and includes a pair of thermocouple probe rods 40 and 42 extending upwardly from the bottom of the furnace 10 or, alternatively, can extend inwardly into the interior heat treating chamber 14 from any desired position surrounding the logs 20. The thermocouple probe rods 40 and 42 extend upwardly through the lower refractory section 18 and the U-shaped channel 24, and are positioned so as to be extendable between rollers 22.

The furnace heating process can be utilized to heat various size logs or billets to a desired temperature, or "set point." For example, one type of furnace system corresponding to the log heating furnace 10 may be employed to heat up to a maximum of 8500 pounds per hour of aluminum billets having a diameter of approximately seven inches. The log heating furnace 10 may be adapted to heat the aluminum billets or logs 20 from a normal temperature of 70° F. to approximately 950° F. The fuel to be employed in such a furnace can, for example, be a natural gas fuel and the heating system may be one where the BTUH capacity would be approximately 7.2 million.

The heating chamber can be of a length of approximately 45 feet, with five zones, each having separate burner nozzles 30. The temperature sensing system 38 and the flame impingement heating system 161 within each zone can be made to operate independent of those associated with other zones.

The thermocouple temperature probes 40 and 42 can be constructed, for example, of type "N" (Nicrosil-Nisil) material. The probe rods 40 and 42 are preferably pointed at their ends and adapted to penetrate the outer layer of the logs 20. In this manner, a circuit connection can be made between the metallic probe rods 40 and 42, with the logs 20 serving as a conductive connecting link.

When the rods 40 and 42 are in contact with a log 20, an electrical potential is established between the rods. The potential causes electric current to flow between the same, and electrical signals representative of the magnitude of the current can be applied through leads 44 to a combustion controller 46. The controller 46 can be employed to control the amount of heat energy supplied to the particular zone of the furnace 10 associated with the probes 40 and 42. For example, controller 46 can control the amount of fuel passing through the fuel line 36 by adjustment of a motor valve 52 controlled by motor 50. Signals to operate the motor 50 are supplied through signal line 48 from the combustion controller 46.

A probe assembly 58 in accordance with the invention and which can be adapted for use in the log heating furnace 10 will now be described with reference to FIGS. 2–5.

Figure 3:
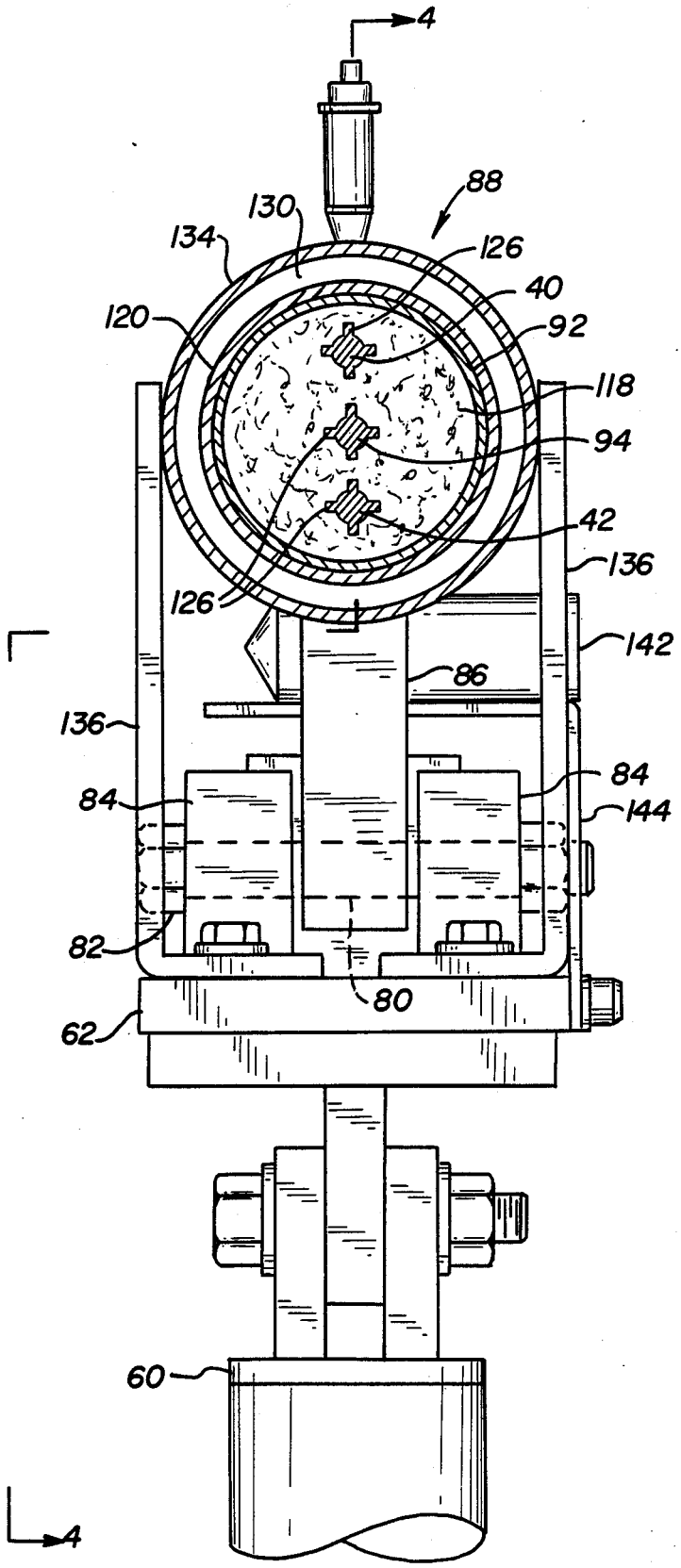
FIG. 3 is a sectional end view of the probe assembly show in FIG. 2 taken along lines 3—3 of FIG. 2.

As shown in FIGS. 3 and 4, the probe assembly 58 is mounted on a support post 60 secured to other portions (not shown) of the log heating furnace 10. The support post 60 mounts a mounting base 62 positioned in a manner so that the probe assembly 58 is in a proper spatial configuration. Connection of the support post 60 to the mounting base 62 can be made by any suitable connecting means.

Figure 4A:
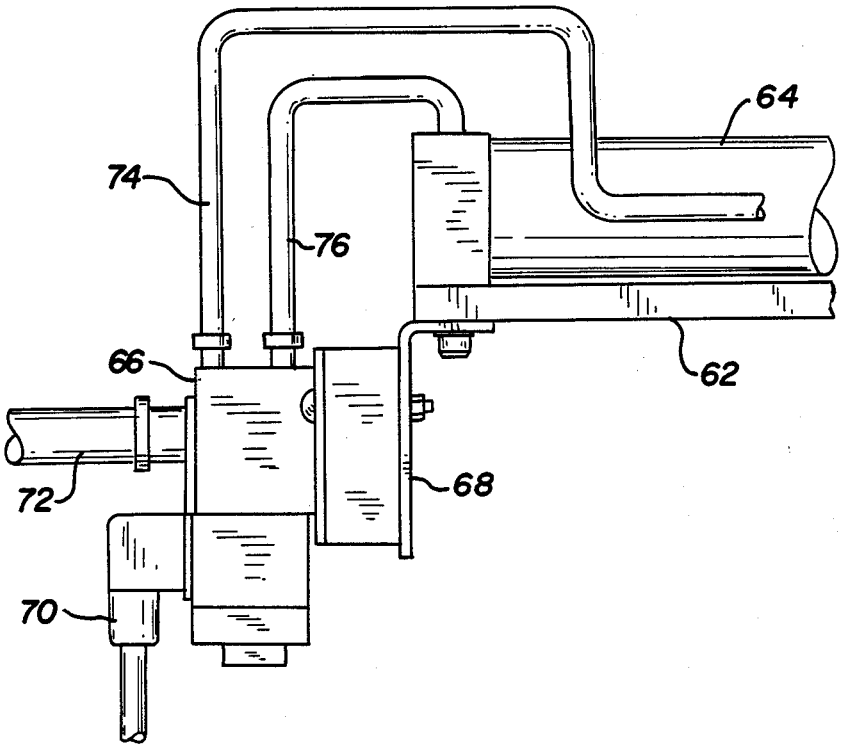
FIG. 4*a* is a sectional side view of a portion of the probe assembly shown in FIG. 2 taken along lines 4—4 of FIG. 3.
Figure 2:
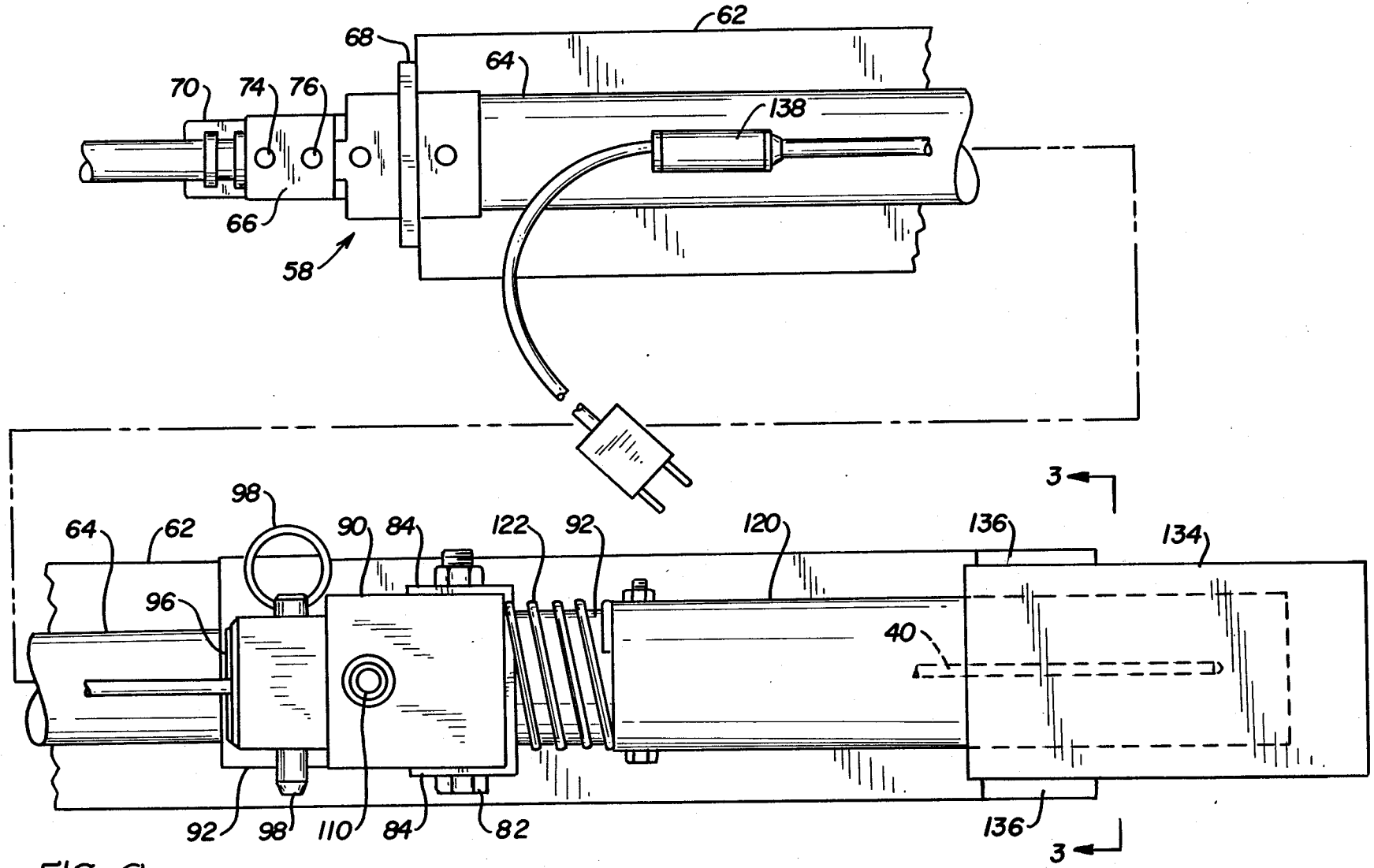
FIG. 2 is a partial plan view of a temperature controlled probe assembly in accordance with the invention.

As shown primarily in FIGS. 2 and 4*a*, mounted to one side of the mounting base 62 is a conventional pneumatic air cylinder 64. The air cylinder 64 is pneumatically controlled by means of a solenoid valve 66 mounted to one end of the mounting base 62 by means of bracket 68. The solenoid valve 66 can be a conventional electrically powered valve adapted for pneumatic control. For example, the valve 66 can be a conventional two position, five way valve having electric power supplied through plug and cord 70.

An air intake hose 72 is coupled to an input port of the solenoid valve 66. Correspondingly, a pair of output air hoses 74 and 76 are coupled to output ports of the solenoid valve 66. Output air hose 74 is applied to one end of the pneumatic cylinder 64, while air hose 76 is coupled to the opposing end of the air cylinder 64. For purposes of clarity of the drawings, the hoses 74 and 76 are not shown in their entirety in FIG. 2.

In accordance with conventional operation of solenoid valves and air cylinders, the solenoid valve 66 can be controlled through power supplied by plug and cord 70 to supply pressurized air through hoses 74 and 76 to the cylinder 64 to actuate reciprocation of an air cylinder shaft 78. The operations of both solenoid valve 66 and air cylinder 64 are conventional.

Figure 4B:
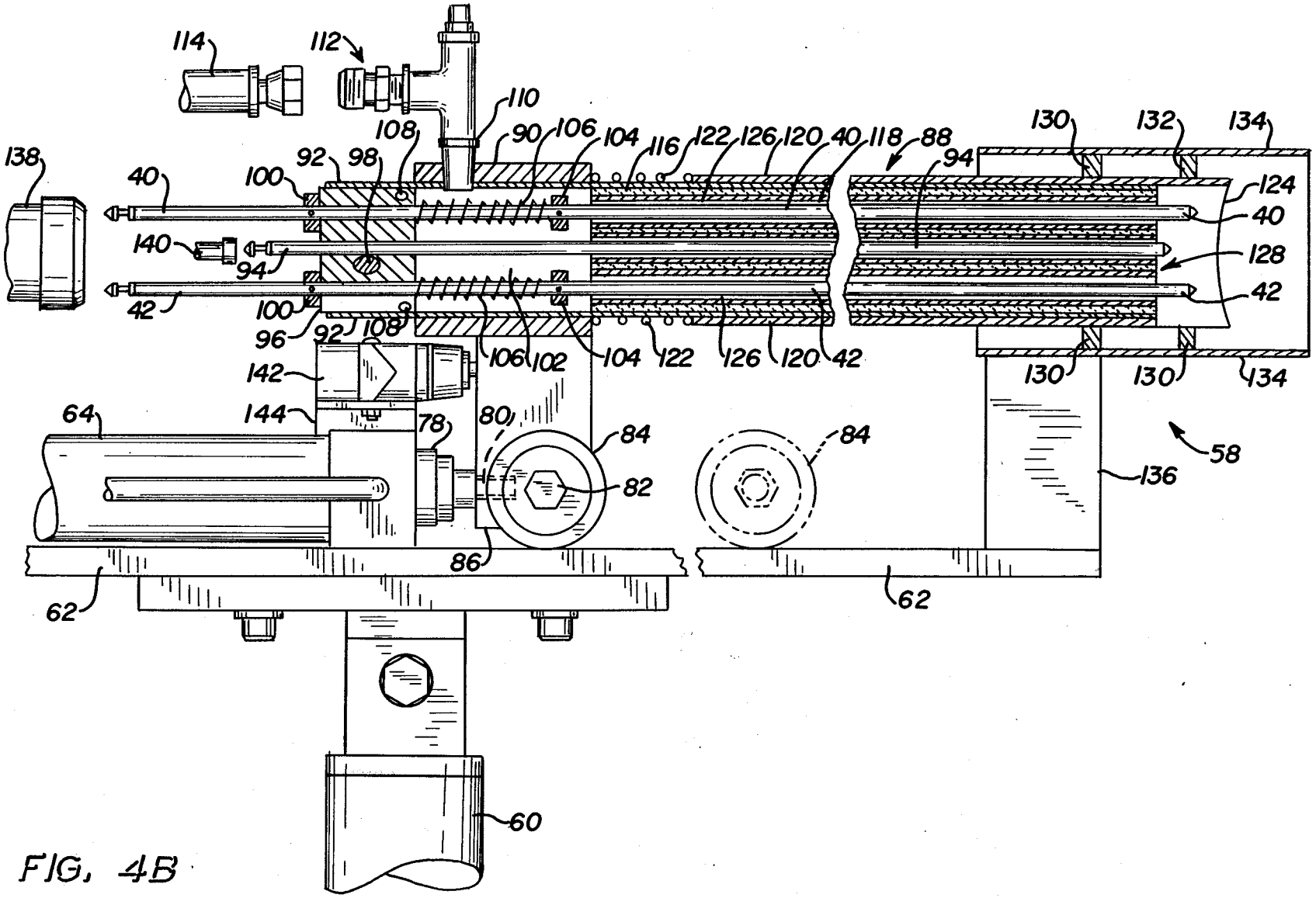
FIG. 4*b* is a sectional side view of the remaining portion of the probe assembly shown in FIG. 2 taken along lines 4—4 of FIG. 3.

Referring to FIGS. 3 and 4*b*, the air cylinder shaft 78 is coupled through a clevis-type connection 80 to a transverse axle pin 82. Axle pin 82 rotatably mounts a pair of rollers 84 engaging the upper surface of the mounting base 62. As the air cylinder shaft 78 is extended or retracted (the shaft 78 being shown in its retracted position in FIG. 4*b*), the rollers 84 are made to follow the motion of cylinder shaft 78 along mounting base 62. For example, the position of one of the rollers 84 is shown in phantom line representation in FIG. 4*b* when the shaft 78 is fully extended.

The axle pin 82 is connected to a vertically disposed thrust bracket 86 providing the primary connection between the shaft 78 and the elements which principally support the probes 40 and 42, the elements being depicted in the drawings as probe carriage 88. The probe carriage 88 includes an annular carriage weldment 90 connected by means such as welds so that it supports and receives through its aperture a probe barrel 92. The probe barrel 92 is an elongated and annular barrel through which each of the thermocouple probe rods 40 and 42 longitudinally extend. A thermocouple 94 referred to herein as an environmental temperature thermocouple 94 also extends through the probe barrel 92 and is positioned intermediate the probes 40 and 42.

Referring to FIG. 4*b*, and particularly the left end portion of the probe barrel 92, a probe rod retainer 96 is partially received through the end cf probe barrel 92 and secured thereto by any suitable connecting means such as the releasable pull pin 98 depicted in FIG. 2. The rod retainer 96 maintains the probe rods 40 and 42 and the environmental thermocouple 94 in a manner so as to avoid lateral movement thereof. To further secure the probe rods 40 and 42 which selectively make direct contact with the logs 20, a first pair of rod set collars 100 are received thereon at the end of the rod retainer 96. The collars 100 are rigidly secured to the probes 40 and 42 through any suitable connecting means such as set screws.

The thermocouple probe rods 40 and 42 extend inwardly from the probe rod retainer 96 into an air chamber 102. The air chamber 102 is cylindrical in cross-section and formed within the portion of probe barrel 92 substantially enclosed by the carriage weldment 90. Within the air chamber 102, a second set of collars 104 are secured to the probes 40 and 42 through set screws. Compression springs 106 abut at one end the second set of collars 104 and the probe rod retainer 96 at their other ends. The air chamber 102 is air sealed at its end adjacent the probe rod retainer 96 by means of an O-ring 108. The springs 106 are suitably compressed so as to bias the probe rods 40 and 42 to the right as viewed in FIG. 4*b*. The collars 100, however, limit the movement of the probe rods 40, 42 to the position shown in FIG. 4*b* so that the collars 104 are spaced a slight distance from the insulative material 118 of air chamber 102.

A conventional nozzle 110 extends into the air chamber 102 and is connected through a conventional pneumatic connection 112 (shown in partially exploded view in FIG. 4b) to an air hose 114 adapted to selectively supply cooling combustion air into the air chamber 102.

The probe rods 40 and 42 extend from within the air chamber 102 into a further section of the probe barrel 92 designated in FIG. 4b as section 116. Barrel section 116 includes insulative material 118 which preferably comprises a silica or similar material for providing insulation of the probes 40 and 42. Mounted around a portion of the barrel section 116 is a barrel sleeve 120 slidably received on the probe barrel 92. Extending between one end of the case weldment 90 and an adjacent end of the barrel sleeve 102 is a compression sleeve spring 122 as depicted in FIGS. 2 and 4b. The barrel sleeve 120 has an annular configuration and is open at its end opposing the end adjacent the case weldment 90. The open end is curved along surface 124, with the curve radius substantially conforming to the curve radius of the outer lateral surfaces of the logs 20.

Referring to FIGS. 3 and 4b, each of the probes 40 and 42 is received within one of a pair of cooling air channels 126. The cooling air channels 126 extend longitudinally through the barrel section 116 and open into the air chamber 102. In addition, the air channels 126 are also open at their opposing ends at a terminating end 128 of the barrel section 116 of the probe barrel 92. The air channels 126 can be of various cross-sectional configurations formed directly through the insulative material 118. In addition, the channels 126 can be formed of a shape and size to support the probes 40 and 42 within the material 118. Channels 126 having such a configuration and size are shown in cross-section in FIG. 3. Alternatively, the channels 126 can have, for example, a circular cross-section with the probes 40 and 42 loosely supported within the channels 126. The cooling air channels 126 provide a means for supplying cooling air to the temperature probes 40 and 42 so as to substantially maintain the probes 40 and 42 at or near a predetermined set point temperature.

Referring to FIG. 4b, the barrel sleeve 120 extends beyond the terminating end 128 of the probe barrel 92 and is supported by means of annular brackets 130 and 132 mounted within an annular carriage support sleeve 134. The carriage support sleeve 134 is of a tubular configuration open at both ends and welded or otherwise secured to a pair of forward carriage mounting brackets 136. The brackets 136 extend downwardly and are secured by suitable connecting means to the front portion of the mounting base 62.

As also shown in FIG. 4b, the ends of the probes 40 and 42 extending outwardly from the probe rod retainer 96 are connectable to a microphone jack 138 or other suitable electrical means to convey current flowing through the probes 40 and 42 to suitable apparatus (not shown) for measuring the current and determining the log temperature therefrom when the probes 40 and 42 are in contact with the logs 20.

The environmental thermocouple 94 is positioned intermediate the probes 40 and 42 and extends parallel to the probes 40 and 42 longitudinally through the probe barrel 92. Like the probes 40 and 42, the environmental thermocouple 94 includes an air channel 126 associated therewith. In addition, the thermocouple 94 terminates within the carriage support sleeve 134 at a position somewhat behind the terminating ends of the probes 40 and 42. Environmental thermocouple 94 is also connectable to a suitable microphone jack 140 for purposes of measuring the temperature in the spatial environment near the ends of probes 40 and 42.

Finally, the probe assembly 58 also includes a limit switch assembly 142 positioned adjacent the thrust bracket 86. The limit switch assembly 142 is mounted to the mounting base 62 by means of the limit switch mounting bracket 144 shown in FIGS. 3 and 4b. When the probe carriage 88 is in its retracted position, the thrust bracket 86 will be in contact with the limit switch 142. Switch 142 can be connected to various electronic circuitry (not shown) to control the timing of the extension of the probes 40 and 42 so as to contact the logs 20 when the logs 20 are in a stationary position. The general concept cf electromechanical components for controlling timing of movement of the probes 40 and 42 is well-known in the art.

As previously referenced, the microphone jack 140 is connected at one end to a terminating end of the environmental thermocouple 94. As shown in block diagram form in FIG. 5, the other end of the jack 140 is connected through a plug or other suitable connecting means to a controller 150. The electrical signal provided through jack 140 as an input signal to the controller 150 is representative of the environmental temperature detected by the thermocouple 94. In addition, adjustment circuit 154 applies an input signal on line 152 to the controller 150 representative of the desired set point temperature for the logs 20. The controller 150 compares the input signal from the adjustment circuit 154 on line 152 with the electrical signal representative of the environmental temperature from jack 140. If the signals indicate that the environmental temperature is of a greater magnitude than the desired set point temperature, a signal is applied on line 156 to a switch circuit 158 which, in turn, is utilized to control activation of a regulator assembly 160 subsequently described herein.

Figure 5:
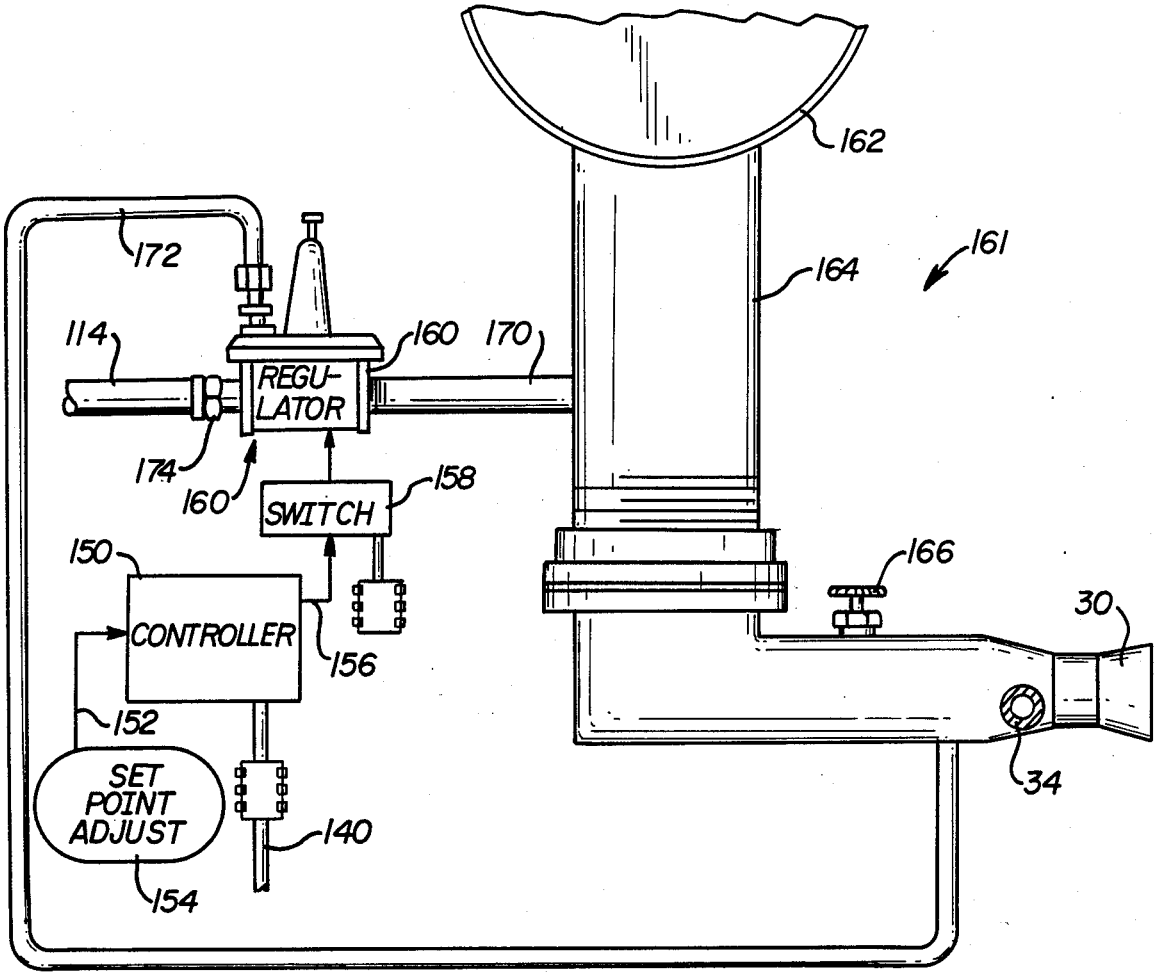
FIG. 5 is a partial schematic representation of a regulator assembly and its interconnection to a combustion air header which can be employed in the temperature controlled probe assembly shown in FIG. 2.

Combustion air for use in mixing with the fuel to provide a combustion flame is provided by means of the combustion air header 162 partially shown in FIG. 5. Air for combustion is brought in from the header 162 through a combustion air pipe supply 164. The air pipe 164 includes a conventional and adjustable air flow control valve 166 which can be in the form of a damper or similar device to adjust the volume of air flowing through the combustion air pipe 164. The air flowing through the combustion air pipe 164 downstream of the adjustable valve 166 is applied to the mixer nozzle 30. Correspondingly, fuel is supplied through the fuel header pipe 34 into the mixer 30. The general concepts and principles of the combustion air and fuel header and flow pipes to provide heat to the logs 20 by means of flame impingement or similar heating arrangements is well-known in the art of billet or log heating furnace design.

The regulator assembly 160 includes an air input pipe 170 connected to the combustion air supply pipe 164 between the combustion air header 162 and the adjustable air valve 166. In addition, an impulse pipe 172 is connected as a tap line to the combustion air pipe 164 between the adjustable air valve 166 and the mixer 30.

The regulator assembly 160 is adapted to receive air from the combustion air pipe 164 through air input pipe 170 and supply the same through output nozzle 174 to the cooling air hose 114. The cooling air hose 114 supplies cooling air to the air chamber 102, probes 40 and 42 and the thermocouple 94.

Activation and deactivation of the regulator assembly 160 are provided by means of the previously described controller 150 and switch 158. Furthermore, however, the actual volume of air supplied through output nozzle 174 to the cooling air hose 114 is made dependent not only upon the volume of air received through air input pipe 170 but also the detected air flow downstream of air valve 16 as measured by impulse pipe line 172. Impulse pipe line 172 is connected between valve 166 and mixer nozzle 30 at one end and to regulator 160 at the other end. Thus, the pressure in impulse line 72 will be proportional to the rate of the flame associated with nozzle 30. That is, the greater the combustion rate, and the hotter the flame, the greater will be the air flow and pressure in impulse line pipe 172. The cooling air flow through regulator 160 is thus controlled by the air pressure or flow downstream of valve 166.

In accordance with the foregoing, the volume of cooling air supplied by regulator assembly 160 through air hose 114 is controlled in a manner so as to be proportional to the volume of air which is actually involved in combustion. That is, if the furnace heating devices are burning at a high combustion rate, the amount of air being used during the combustion process will be relatively high and the pressure in pipe 172 will correspondingly be relatively high. On the other hand, if the heating devices are burning at a relatively low combustion rate or are essentially turned off, the low pressure in pipe 172 will cause the amount of air flowing through cooling air hose 114 to be relatively small. In addition, the thermocouple 94 will control the activation or deactivation of regulator 160 in accordance with the temperature of the temperature measuring probes 40 and 42 relative to the set point temperature. Pressure controlled regulator assemblies are well-known and commercially available.

The operation of the probe assembly 58 and its corresponding functional relationship with the heater assembly 161 will now be described with respect to FIGS. 1–5.

When the logs 20 are moving through the log heating furnace 10, the probe assembly 58 for a particular zone or region of the furnace housing 12 will be in a retracted position as shown in FIG. 4*b*. When the logs 20 are stopped and remain stationary during an intermittent time period, appropriate signals will be applied to the solenoid valve 66 through plug and cord 70 or any other appropriate electrical means so as to apply air through the solenoid output air hoses 74 and 76. Air hoses 74 and 76, being connected to the pneumatic air cylinder 64, will activate cylinder 64 so as to extend air cylinder shaft 78 to the right as depicted in FIG. 4*b*.

Extension of the air cylinder shaft 78 will cause the rollers 84 to roll along the upper surface of mounting base 62. Correspondingly, cylinder shaft 78 will exert forces on the probe carriage 88 through the interconnecting thrust bracket 86. With the thrust bracket 86 connected to the probe carriage 88 through carriage weldment 90, carriage 88 will also be moved to the right as depicted in FIG. 4. As carriage 88 is extended and moves toward the logs 20, the curved surface 124 of barrel sleeve 120 will first contact the lateral surface of a log 20. The probe barrel 92 will then continue to move forward, with the sleeve spring 122 correspondingly being compressed. The probe barrel 92 continues movement until the log temperature measuring probes 40 and 42 penetrate the outer surface of log 20, thereby compressing spring 106. When penetration is made, appropriate electrical controls (not shown) will measure the current flowing through probes 40 and 42 as the current is applied to such controls through the microphone jack 138. The temperature of the logs as measured by the probes 40 and 42 can be utilized to control the combustion rate of the furnace heaters so as to move the log temperature toward the desired set point temperature.

When the log temperature has been measured and prior to initiation of movement of the logs 20, appropriate pneumatic control will be applied to air cylinder 64 through the solenoid valve 66 so as to retract the air cylinder shaft 78. Retraction of the cylinder shaft 78 will correspondingly cause the probes 40 and 42 to move out of contact with the logs 20 and the probe carriage 88 will be returned to its retracted position as shown in FIG. 4. The limit switch 142 can be utilized to detect return of the probe carriage 88 to the fully retracted position.

One problem associated with measurement of log temperatures by means of direct probe contact relates to the potential temperature differences between the logs and the probes. That is, if the probe measuring devices themselves are at a different temperature than the logs, this temperature differential can cause substantial difficulties in obtaining accurate temperature measurements. It is relatively common for the probes to be at a higher temperature than the metal logs. Accordingly, the logs can actually produce a "heat sink" effect. This heat sink effect produces inaccuracies in the proportionality of the electric current flowing through the probes relative to the log temperatures. Accordingly, erroneous temperature measurements can be obtained.

To overcome this problem, cooling air is supplied to the air chamber 102 from the cooling air hose 114 and the pneumatic nozzle connection 112. The air chamber 102 is directly connected to the air channels 126 in which the probes 40, 42 and thermocouple 94 are received. To achieve the direct connection between air chamber 102 and the air channels 126, the probe supporting collars 104 are maintained within the air chamber 102 a predetermined and relatively small distance away from the openings of the air holes 126 by collars 100. To seal the air chamber 102, the O-ring 108 is positioned between the probe retainer 96 and the probe barrel 92.

It is desirable for the volume of cooling air to be dependent upon the temperature difference between the probes 40, 42 and the logs 20. To achieve this objective, the environmental thermocouple 94 is utilized to measure the temperature in the spatial area adjacent the probes 40 and 42. This environmental temperature measurement will provide a good approximation of the actual temperatures of the probes 40 and 42. It should be emphasized that the environmental thermocouple 94 does not directly contact the logs 20 when the probe carriage 88 is moved into its extended position when the logs are stationary.

The temperature measured by the environmental thermocouple 94 is represented by an electric current which is applied through the microphone jack 140 to the regulator controller 150 as depicted in FIG. 5. The regulator controller 150 compares the temperature measured by the environmental thermocouple 94 with the predetermined set point temperature which can be set through adjustment circuit 154 and applied as a representative electrical signal on line 152 to the controller 150. The controller 150 essentially provides an "on-off" determination as to whether cooling air should be supplied to the probes 40 and 42. That is, if the temperature measured by the environmental thermocouple 94 is less than the desired set point temperature, the controller 150 will maintain the regulator switch 158 in an off state and override the regulator 160 so that cooling air is not supplied. On the other hand, if the temperature measured by the environmental thermocouple 94 indicates that the spatial temperature around the probes 40 and 42 is greater than the desired set point log temperature, the switch 158 activates the regulator 160 so as to apply cooling air through nozzle 174 to the cooling air hose 114.

To achieve the objective of supplying a volume of cooling air which is also dependent on the combustion rate or amount of thermal energy being applied to the logs 20, the regulator assembly 160 supplies a volume of cooling air through hose 114 which is dependent upon the pressure or air flow in impulse line 172. If the combustion rate of the heater assembly 161 is relatively low, the pressure in pipe 172 will be relatively low, and the regulator assembly 160 will supply only a small amount cf cooling air through the hose 114. If the combustion rate of the heater assembly is relatively high, a correspondingly relatively high volume of air will be flowing through air pipe 164 and the pressure in pipe 172 will be relatively high. In such event, the volume of air supplied through cooling air hose 114 will also be relatively high. In this manner, the volume of cooling capacity supplied around the probes 40 and 42 will increase as the combustion rate of the heater 161 increases. That is, as the impingement flame obtained from heater assembly 161 burns hotter, the volume of cooling air supplied to the probes 40 and 42 will correspondingly be increased. An appropriate amount of cooling capacity is thereby supplied to the probes 40 and 42 so as to maintain the probes at a temperature substantially near the set point temperature of the logs 20. In addition, the thermocouple 94 essentially provides an "override" function to the regulator assembly 160 so that the cooling air supplied to probes 40 and 42 can be shut off if the temperature of the probes is less than the set point temperature, notwithstanding the combustion rate of the heater assemblies.

The principles of the invention are not limited to the specific log heating furnace and probe assembly 58 described herein. For example, it will be apparent to those skilled in the art that various other types of heating assemblies can be utilized without altering the basic concepts cf the invention relating to the application of cooling air to the temperature measuring probes and regulation of the cooling air volume in accordance with the combustion rate of the heating assemblies. It will further be apparent to those skilled in the art that modifications and variations of the above-described illustrative embodiment of the invention may be effected without departing from the spirit and scope of the novel concepts of the invention.

The embodiments of the invention in which an exclusive property or privilege is claimed are defined as follows:

1. In a furnace for heating articles to an elevated set point temperature and comprising a heating chamber through which the articles are moved, combustion means for generating and applying thermal energy within the heating chamber to heat the articles, combustion air supply means for supplying air to the combustion means, and thermocouple probe means including thermocouple probe rods for contacting the articles and measuring the temperature of the articles so as to regulate the energy applied to the articles by the combustion means, the improvement which comprises:

environmental temperature measuring means for measuring the temperature of the environment surrounding the thermocouple probe rods or the temperature of the actual thermocouple probe rods, and for generating an environmental temperature signal representative of the measured environmental temperature;

cooling air supply means responsive to the environmental temperature signal for selectively supplying cooling air to the thermocouple probe rods in accordance with the difference between the environmental temperature and a predetermined temperature; and the cooling air supply means comprises regulator means for adjusting the flow of supplied cooling air to the thermocouple probe rods in accordance with the rate of air flow through the combustion air supply means.

2. A furnace in accordance with claim 1 wherein the combustion air supply means comprises a source of air for combustion, an air flow pipe for supplying air from the air source to the combustion means and an air flow control valve mounted in the air flow pipe to control the amount of air supplied through the pipe to the combustion means, and the regulator means comprises:

air connecting means communicating with the air flow pipe between the air source and the air flow control valve for receiving cooling air therefrom and supplying the cooling air to the thermocouple probe rods; and means communicating with the air flow pipe between the air flow control valve and the combustion means to detect the air flow rate to the combustion means and adjust the flow of air through the connecting means in accordance with the rate of combustion air flow to the combustion means.

3. A furnace in accordance with claim 1 wherein the cooling air supply means comprises:

comparison means responsive to the environmental temperature signal and to a signal representative of the predetermined temperature to generate an activation signal when the environmental temperature is greater than the predetermined temperature; and switch means responsive to the activation signal for activating the regulator means to supply cooling air to the probe rods.

4. A furnace in accordance with claim 1 wherein the environmental temperature measuring means comprises at least one thermocouple located adjacent the thermocouple probe rods.

5. A furnace in accordance with claim 1 wherein the thermocouple probe means further comprises:

means for mounting the thermocouple probe rods so as to be selectively movable into contact with the articles; and air channels extending through the mounting means, at least partially surrounding the probe rods and communicating with the cooling air supply means to allow cooling air to be applied around and along the thermocouple probe rods.

6. In a method for heating articles to an elevated set point temperature within a heating chamber of a furnace through which the articles are moved, and comprising the steps of:

applying thermal energy within the chamber to heat the articles;

measuring the temperature of the articles by contacting the articles with a set of thermocouple probe rods; and adjusting the amount of applied energy in accordance with the measured articles temperature so as to adjust the temperature of the articles toward the set point temperature;

the improvement wherein the method further comprises the steps of:

measuring the temperature of the environment surrounding the thermocouple probe rods or the temperature of the actual thermocouple probe rods;

supplying cooling air to the thermocouple probe rods when the environmental temperature is greater than a predetermined temperature; and adjusting the flow of supplied cooling air to the thermocouple probe rods in accordance with the amount of thermal energy being applied to the articles.

7. In a furnace for heating articles to an elevated set point temperature and comprising a heating chamber through which the articles are moved, combustion means for generating and applying thermal energy within the heating chamber to heat the articles, combustion air supply means for supplying air to the combustion means, and thermocouple probe means including thermocouple probe rods for contacting the articles and measuring the temperature of the articles so as to regulate the energy applied to the articles by the combustion means, the improvement which comprises:

environmental temperature measuring means for measuring the temperature of the environment surrounding the thermocouple probe rods or the temperature of the actual thermocouple probe rods, and for generating an environmental temperature signal representative of the measuring environmental temperature;

cooling air supply means responsive to the environmental temperature signal for selectively supplying cooling air to the thermocouple probe rods in accordance with the difference between the environmental temperature and a predetermined temperature; and the thermocouple probe means further comprises a probe carriage comprising:

an elongated barrel having an air chamber and an insulative section adjacent the air chamber, and wherein the thermocouple probe rods extend longitudinally through the barrel;

air channels extending through the insulative section and in which the thermocouple probe rods are received; and collar means for maintaining communicative openings between the air channels and the air chamber.

8. A furnace in accordance with claim 7 wherein the cooling air supply means comprises means communicating with the air chamber for supplying cooling air to the thermocouple probe rods.

9. A furnace in accordance with claim 7 wherein the environmental temperature measuring means comprises a thermocouple extending through the barrel adjacent the thermocouple probe rods.

10. A furnace in accordance with claim 7 wherein the cooling air supply means comprises regulator means for adjusting the flow of supplied cooling air to the air chamber in accordance with the rate of air flow through the combustion air supply means.

11. A furnace in accordance with claim 7 and further comprising means for moving the probe carriage between a retracted position and an extended position, and the thermocouple probe rods contact the articles when the carriage is in the extended position.

12. In a furnace for heating articles to an elevated set point temperature and comprising a heating chamber through which the articles are moved, combustion means for generating and applying thermal energy within the heating chamber to heat the articles, combustion air supply means for supplying air to the combustion means, probe mounting means movable between an extended position and a retracted position, and thermocouple probe rods supported by the probe mounting means for contacting the articles when the mounting means is in an extended position and for measuring the temperature of the articles, the improvement comprising:

air channels at least partially surrounding the thermocouple probe rods;

means communicating with the air channels to supply cooling air to the thermocouple probe rods; and regulator means for regulating the amount of supplied cooling air to the thermocouple probe rods in accordance with the combustion rate of the combustion means.

13. A furnace in accordance with claim 12 and further comprising means connected to the regulator means for selectively activating the regulator means only when the measured environmental temperature is greater than a predetermined temperature.

14. A furnace in accordance with claim 13 wherein the combustion air supply means comprises a source of combustion air, an air supply pipe for applying air to the combustion means and an adjustable air control valve for adjusting the amount of air supplied to the combustion means through the air supply pipe; and the regulator means comprises means connected to the air supply pipe between the air source and the air control valve to receive air from the air pipe and supply cooling air to the thermocouple probe rods, and means connected to the air supply pipe between the air control valve and the combustion means for detecting the amount of air flowing to the combustion means and adjusting the volume of cooling air supplied from the air supply pipe to the thermocouple probe rods in accordance therewith.

15. In a method for heating articles to an elevated set point temperature within a heating chamber of a furnace through which the articles are moved, and comprising the steps of:

supplying air to a combustion device to generate thermal energy;

applying the thermal energy within the chamber to heat the articles;

measuring the temperature of the articles by contacting the articles with a set of thermocouple probe rods; and adjusting the amount of applied energy in accordance with the measured article temperature so as to adjust the temperature of the articles toward the set point temperature;

the improvement wherein the method further comprises the steps of:

supplying cooling air to the thermocouple probe rods; and regulating the amount of supplied cooling air to the thermocouple probe rods in accordance with the combustion rate of the combustion device.

16. The method in accordance with claim 15 and further comprising the steps of:

supplying the air to the combustion device through an air supply pipe;

adjusting the amount of air supplied to the combustion device by means of a flow control valve in the air supply pipe;

supplying the cooling air to the thermocouple probe rods from the air flowing through the air supply pipe upstream from the flow control valve: and detecting the amount of air flowing through the air supply pipe between the flow control valve and the combustion device and adjusting the volume of cooling air supplied from the air supply pipe to the thermocouple probe rods in accordance therewith.

17. The method in accordance with claim 15 and further comprising the steps of:

measuring the temperature of the environment surrounding the thermocouple probe rods or the temperature of the actual thermocouple probe rods; and supplying cooling air to the thermocouple probe rods only when the environmental temperature is greater than a predetermined temperature.

* * * * *